US009655811B2

(12) United States Patent
Gallo et al.

(10) Patent No.: US 9,655,811 B2
(45) Date of Patent: May 23, 2017

(54) LIQUID HEATER

(71) Applicant: Divine Solutions Inc, Chattanooga, TN (US)

(72) Inventors: Jennifer Ann Gallo, Lawrenceville, GA (US); William T. White, IV, Decatur, GA (US)

(73) Assignee: Divine Solutions Inc., Chattanooga, TN (US)

( * ) Notice: Subject to any disclaimer, the term of this patent is extended or adjusted under 35 U.S.C. 154(b) by 87 days.

(21) Appl. No.: 14/840,093

(22) Filed: Aug. 31, 2015

(65) Prior Publication Data

US 2016/0206505 A1 Jul. 21, 2016

Related U.S. Application Data

(60) Provisional application No. 62/125,326, filed on Jan. 20, 2015.

(51) Int. Cl.
*A47K 3/00* (2006.01)
*A61H 33/00* (2006.01)
(Continued)

(52) U.S. Cl.
CPC ..... *A61H 33/0095* (2013.01); *F24H 1/06* (2013.01); *F24H 1/10* (2013.01);
(Continued)

(58) Field of Classification Search
CPC ..... A61H 33/0095
(Continued)

(56) References Cited

U.S. PATENT DOCUMENTS 5,199,116 A * 4/1993 Fischer ..... A47K 3/10 4/541.2
5,226,408 A * 7/1993 Drysdale ..... F24J 3/006 126/247

(Continued)

*Primary Examiner* — Huyen Le
(74) *Attorney, Agent, or Firm* — Next IP Law Group LLC; Minh N. Nguyen

(57) ABSTRACT

Disclosed herein is a representative liquid heater that maintains a liquid temperature at a consistent and desirable temperature. The liquid heater includes a housing, a liquid pump, a temperature controller, and a mounting structure. The housing houses a power supply and a heating element that receives power from the power supply. The liquid pump receives power from the power supply and pumps liquid from a liquid container to the heating element, which heats the water. The temperature controller turns on or off the heating element to increase and/or decrease the temperature of the liquid from the liquid container. The mounting structure includes an inlet structure and an outlet structure, both of which are connected to the housing. The inlet structure receives liquid from the liquid container and the outlet structure ejects the liquid from the housing. The inlet structure and the outlet structure are configured to be in a "U" shape such that the inlet structure and the outlet structure can be mounted on the edge of the liquid container. A base of the U-shaped inlet structure and outlet structure rests on the top edge of the liquid container and the two arms of the U-shaped inlet structure and outlet structure are adjacent to a wet side and a dry side of the liquid container. The base of the U-shaped inlet structure and the outlet structure are configured to be telescopic that expands to accommodate various thicknesses of at least one liquid container.

9 Claims, 5 Drawing Sheets

(51) Int. Cl.
*F24H 1/06* (2006.01)
*F24H 1/10* (2006.01)

(52) U.S. Cl.
CPC ..... *A61H 2201/0207* (2013.01); *A61H 2201/0228* (2013.01); *F24H 2250/00* (2013.01)

(58) Field of Classification Search
USPC ..... 4/541.1, 541.2, 490
See application file for complete search history.

(56) References Cited

U.S. PATENT DOCUMENTS 5,241,958 A * 9/1993 Noeldner ..... A61H 35/00 4/541.4
5,245,714 A * 9/1993 Haraga ..... A61H 33/02 134/22.12
2005/0235406 A1 * 10/2005 August ..... A61H 33/0087 4/493

* cited by examiner

LIQUID HEATER

CROSS REFERENCE TO RELATED APPLICATIONS

This application claims the benefit of U.S. provisional application having Ser. No. 62/125,326 filed on Jan. 20, 2015, all of which are entirely incorporated herein by reference.

TECHNICAL FIELD

The present disclosure is generally related to liquid heater and, more particularly, is related to systems and methods for heating and maintaining liquid temperature at a consistent and desirable temperature.

BACKGROUND

Currently, there are various products on the market that can heat water in a bath spa. Bath spas can be categorized into two types. The first type is designed to be laid on while taking a bath. These mat-style spas typically heat the bath water by pumping in warm air. This also allows the air jets to create massaging feeling for the user. While most mat-styled bath mats are capable of efficiently warming and circulating the bath water, many are ergonomically flawed due to their size which may not comply with certain tub dimensions, shape that is inconvenient for certain users, and materials that, when not padded sufficiently, is not comfortable of users to lay or sit on.

The second type of bath spa involves the use of a spa motor. These spas use jets to pump heated air bubbles into the water. One advantage of the portable jet bath spas is their size and cost; however, the jets do not circulate the water as well as most other bath spas. Certain larger, more expensive jet bath spas need to be installed into the side of a tub to function. In addition, these jet-powered bath spas are unable to warm the water.

Other similar devices include immersion circulators, which are used to cook food, aquarium heaters, which are used to support aquatic habitats, and standard household water heating tank.

Desirable in the art is an improved liquid heater that would improve upon the conventional liquid heater.

SUMMARY

Disclosed herein is a representative liquid heater that maintains a liquid temperature at a consistent and desirable temperature. The liquid heater includes a housing, a liquid pump, a temperature controller, and a mounting structure. The housing houses a power supply and a heating element that receives power from the power supply. The liquid pump receives power from the power supply and pumps liquid from a liquid container to the heating element, which heats the water. The temperature controller turns on or off the heating element to increase and/or decrease the temperature of the liquid from the liquid container. The mounting structure includes an inlet structure and an outlet structure, both of which are connected to the housing. The inlet structure receives liquid from the liquid container and the outlet structure ejects the liquid from the housing. The inlet structure and the outlet structure are configured to be in a "U" shape such that the inlet structure and the outlet structure can be mounted on the edge of the liquid container. A base of the U-shaped inlet structure and outlet structure rests on the top edge of the liquid container and the two arms of the U-shaped inlet structure and outlet structure are adjacent to a wet side and a dry side of the liquid container. The base of the U-shaped inlet structure and the outlet structure are configured to be telescopic that expands to accommodate various thicknesses of at least one liquid container.

BRIEF DESCRIPTION OF THE DRAWINGS

The accompanying drawings illustrate preferred embodiments of the invention, as well as other information pertinent to the disclosure, in which.

DETAILED DESCRIPTION

Exemplary systems are first discussed with reference to the figures. Although these systems are described in detail, they are provided for purposes of illustration only and various modifications are feasible. After the exemplary systems are described, examples of the systems, devices, and structures are provided to explain the manner in which the liquid heater can maintains liquid temperature at a consistent and desirable temperature.

Which of the oppositely flowing liquid are to be deemed inputs and which are to be deemed outputs is simply a matter of perspective; however the distinction of input versus output is made in this disclosure for ease of explanation when distinguishing between the opposite liquid flows.

Figure 1:
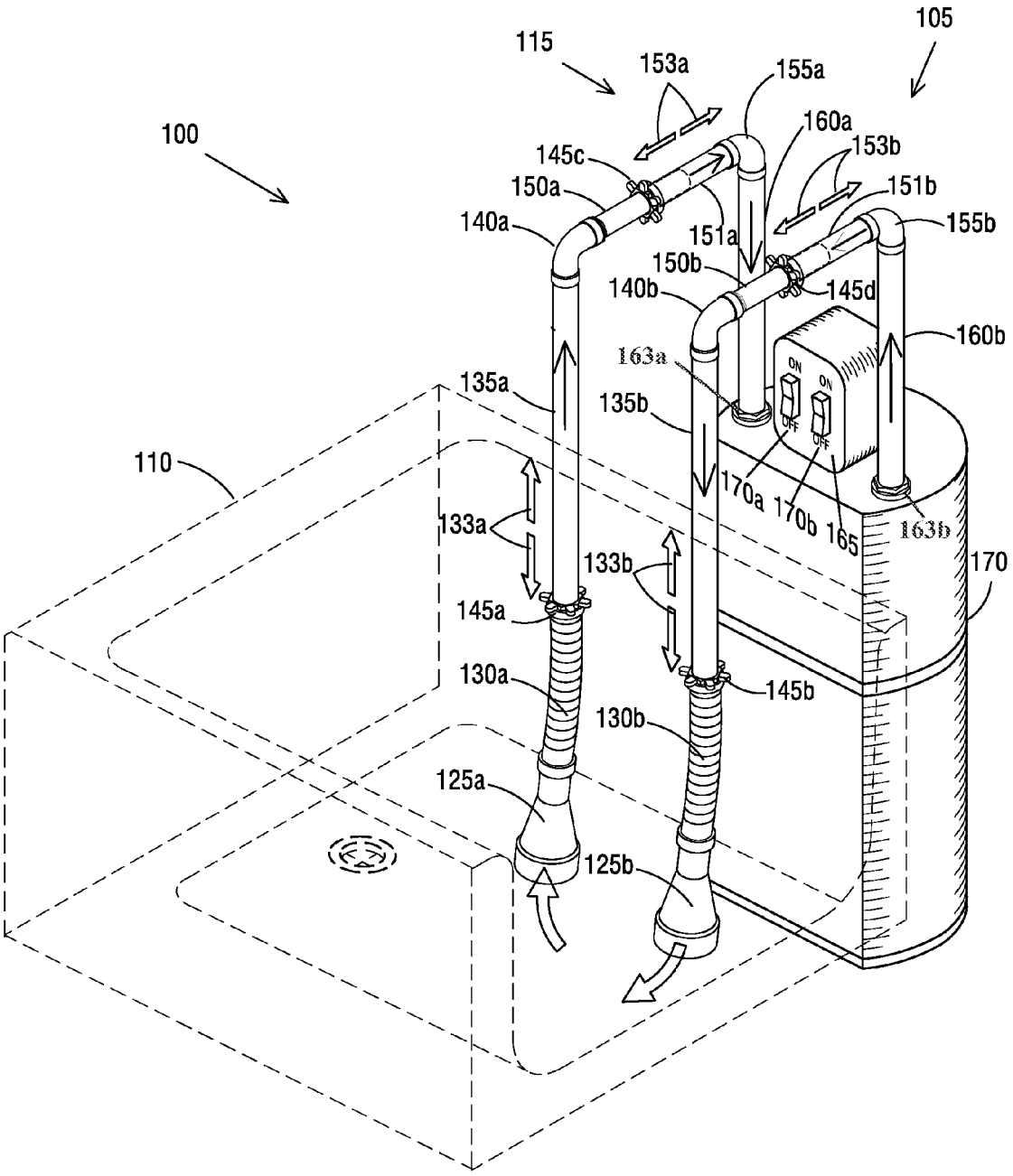
FIG. 1 is a perspective view that illustrates a liquid heater system having an embodiment of a liquid heater that is positioned on a square tub.

FIG. 1 is a perspective view that illustrates a liquid heater system 100 having an embodiment of a liquid heater 105 that is positioned on a liquid container 110, such as a square tub 110 that is shown. The liquid heater 105 can be mounted on the square tub 110 using a mounting structure 115. The mounting structure 115 includes an inlet structure and an outlet structure, both of which are connected to the housing.

In this example, the inlet structure and outlet structure include inlet 125*a* and outlet 125*b*, flexible inlet and outlet extensions 130*a*, 130*b*, wet-side arms 135*a*, 135*b*, base structure 150*a*, 150*b*, 151*a*, 151*b*, and dry-side arms 160*a*, 160*b*. The inlet structure 125*a*, 130*a*, 135*a*, 150*a*, 150*b*, 160*a* receives liquid (not shown) from the liquid container and the outlet structure 125*b*, 130*a*, 135*b*, 150*b*, 150*b*, 160*b* ejects the liquid from a housing 170.

The flexible inlet and outlet extensions 130*a*, 130*b* can be positioned along the wet-side arms 135*a*, 135*b* in the direction 133*a*, 133*b*, respectively. The flexible inlet and outlet extensions 130*a*, 130*b* enable a user to position the inlet 125*a* and outlet 125*b* in different locations inside the square tub 110. The flexible inlet and outlet extensions 130*a*, 130*b* are coupled to the wet-side arms 135*a*, 135*b* via liquid seal fasteners 145*a*, 145*b*.

The inlet structure and the outlet structure are configured to be in a "U" shape such that the inlet structure and the outlet structure can be mounted on the edge of the square tub 110. The bases 150*a*, 150*b*, 151*a*, 151*b* of the U-shaped inlet structure and outlet structure rest on the top edge of the square tub 110 and the wet-side and dry-side arms 135*a*, 135*b*, 160*a*, 160*b* of the U-shaped inlet structure and outlet structure are adjacent to a wet side and a dry side of the square tub 110. The base 150*a*, 150*b*, 151*a*, 151*b* of the U-shaped inlet structure and the outlet structure are configured to be telescopic that expands to accommodate various thicknesses of at least one liquid container, such as the square tub 110 that is shown. The base 150*a*, 150*b*, 151*a*, 151*b* can be expanded and contracted in directions 153*a*, 153*b*. The telescopic base 150*a*, 150*b*, 151*a*, 151*b* are coupled together using liquid seal fasteners 145*c*, 145*d*, respectively. The base 150*a*, 15*b*, 151*a*, 151*b* are attached to the wet-side arms 135*a*, 135*b* and dry-side arms 160*a*, 160*b* using "L" shape couplers 140*a*, 140*b*, 155*a*, 155*b*, respectively. The base 150*a*, 150*b*, 151*a*, 151*b* are shown and will be described in more detail in FIG. 3.

The dry-side arms 160*a*, 160*b* are attached to the housing 170 using liquid seal fasteners 163*a*, 163*b*, respectively. The housing 170 includes a controller 165 having pump and heater switches 170*a*, 170*b* to turn on and off a pump 405 (FIG. 4) and a heater 420 (FIG. 4) that are located inside the housing 170. The components inside the housing 170 are shown and will be described in more detail in FIG. 4.

Alternatively or additionally, the mounting structure can include suction cups (not shown) that are attached on the housing 170, on the U-shaped structure, and on the flexible inlet and outlet extensions 130*a*, 130*b*, and on the inlet 125*a* and outlet 125*b* so the user can adjust where the liquid is flowing.

Figure 2:
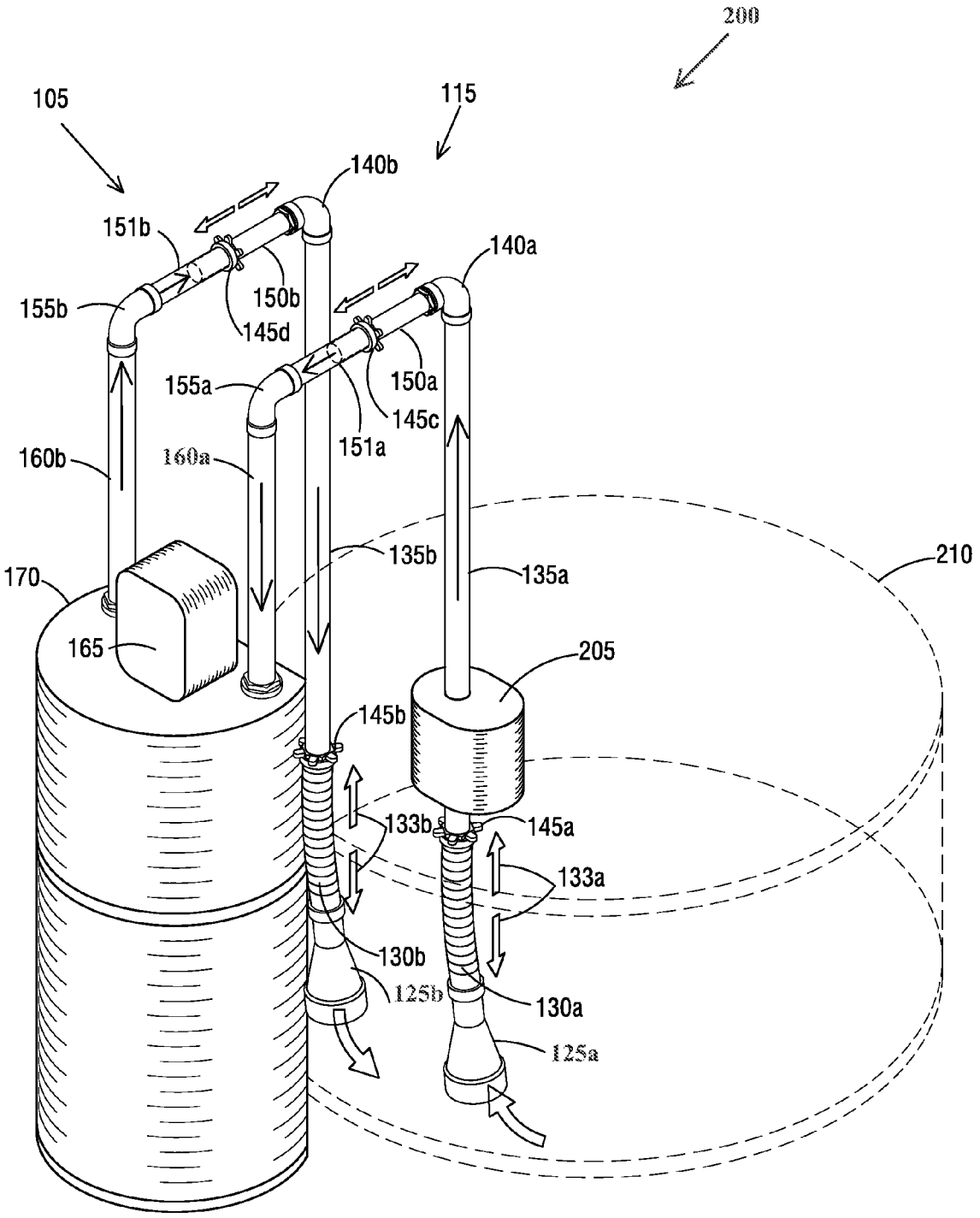
FIG. 2 is a perspective view that illustrates an another embodiment of a liquid heater that is positioned on a circular tub.

FIG. 2 is a perspective view that illustrates a liquid heater system 200 an embodiment of a liquid heater 105, such as that shown in FIG. 1, that is positioned on a liquid container 210, such as a circular tub that is shown. In this example, the architecture of the liquid heater system 200 of FIG. 2 is similar to the architecture of the liquid heater system 100 as described in FIG. 1. Like features are labeled with the same reference numbers, such as the inlet 125*a* and outlet 125*b*, flexible inlet and outlet extensions 130*a*, 130*b*, wet-side arms 135*a*, 135*b*, base structure 150*a*, 150*b*, 151*a*, 151*b*, dry-side arms 160*a*, 160*b*, controller 165, and housing 170. The liquid heater system 200 further includes a submersible pump 205 that is located in the circular tub 210.

Figure 3:
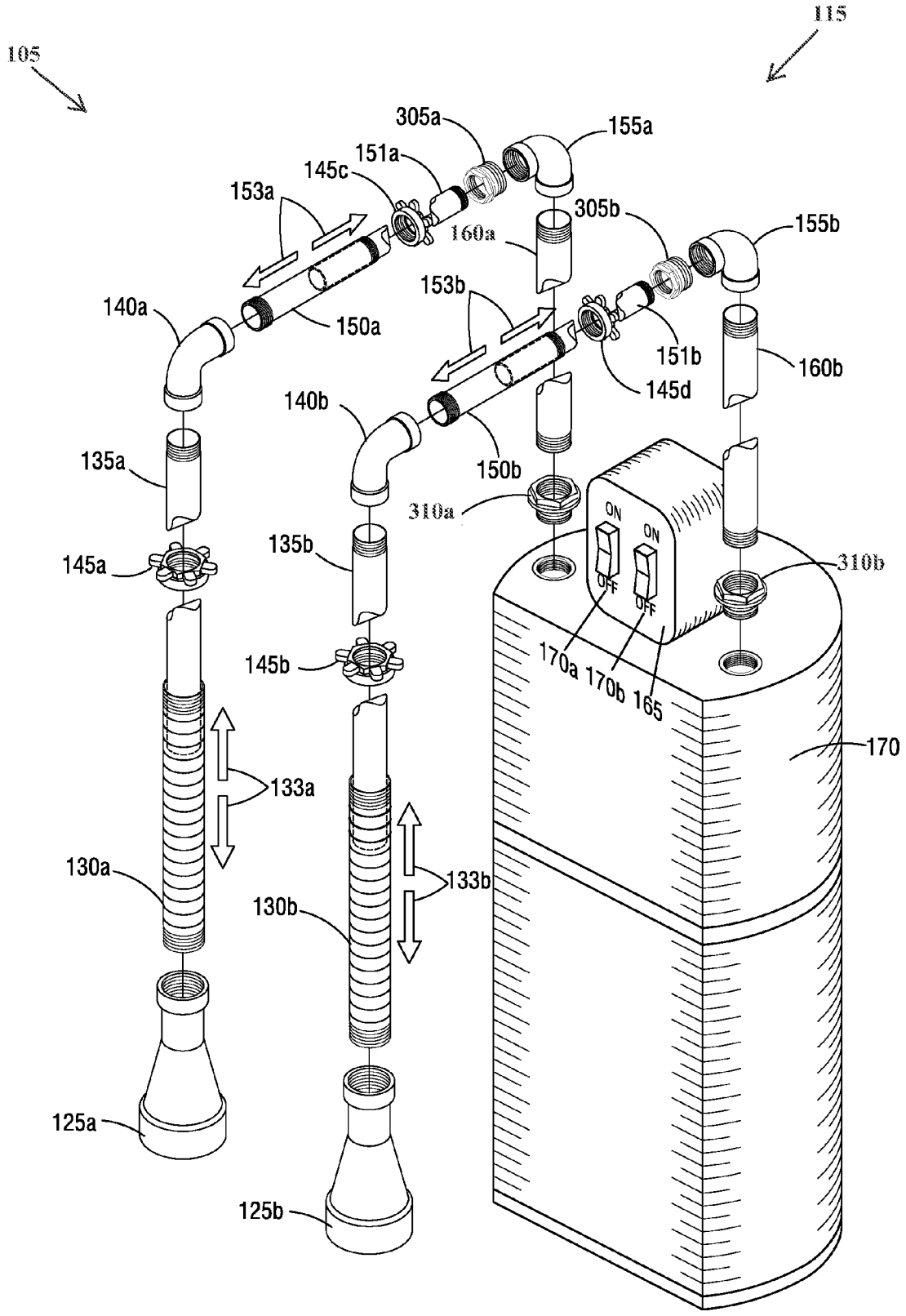
FIG. 3 is preassembly view that illustrates an embodiment of a liquid heater, such as that shown in FIG. 1.

FIG. 3 is preassembly view that illustrates an embodiment of a liquid heater, such as that shown in FIG. 1. In this example, the architecture of the liquid heater 105 of FIG. 3 is the same architecture of the liquid heater 105 as described in FIG. 1. Like features are labeled with the same reference numbers, such as the inlet 125*a* and outlet 125*b*, flexible inlet and outlet extensions 130*a*, 130*b*, wet-side arms 135*a*, 135*b*, base structure 150*a*, 150*b*, 151*a*, 151*b*, dry-side arms 160*a*, 160*b*, controller 165, and housing 170.

The inlet 125*a* and outlet 125*b* are screwed onto at a proximal end of the flexible inlet and outlet extensions 130*a*, 130*b*. The wet-side arms 135*a*, 135*b* are fitted into at the distal end of the flexible extensions 130*a*, 130*b*. The liquid seal fastener 145*a*, 145*b* are screwed onto at the distal end of the flexible extensions 130*a*, 130*b* at various positions along the wet-side arms 135*a*, 135*b*. The proximal and distal ends of the L-shaped couplers 140*a*, 140*b* are screwed onto the wet-side arms 135*a*, 135*b* and the base structure 150*a*, 150*b*.

Similarly, the proximal and distal ends of the L-shaped couplers 140*a*, 140*b* are screwed onto the base structure 151*a*, 151*b* and the dry-side arms 160*a*, 160*b* using couplers 305*a*, 305*b*. The exterior members 150*a*, 150*b* and the interior members 151*a*, 151*b* are coupled together via liquid seal fasteners 145*c*, 145*d*. The interior members 151*a*, 151*b* can move within and along the exterior members 150*a*, 150*b* in the direction 153*a*, 153*b*, such that the length of the base structure can be adjusted to be mounted on many different types, sizes, and shapes of liquid containers. The interior members 151*a*, 151*b* are smaller than the exterior members 150*a*, 150*b* such that the interior members 151*a*, 15 lb are housed by the exterior members 150*a*, 150*b*. The liquid seal fasteners 145*c*, 145*d* between the interior member and exterior member prevent the liquid from leaking out of the telescopic base. The dry-side arms 160*a*, 160*b* are screwed onto the housing using couplers 310*a*, 310*b*.

Figure 4:
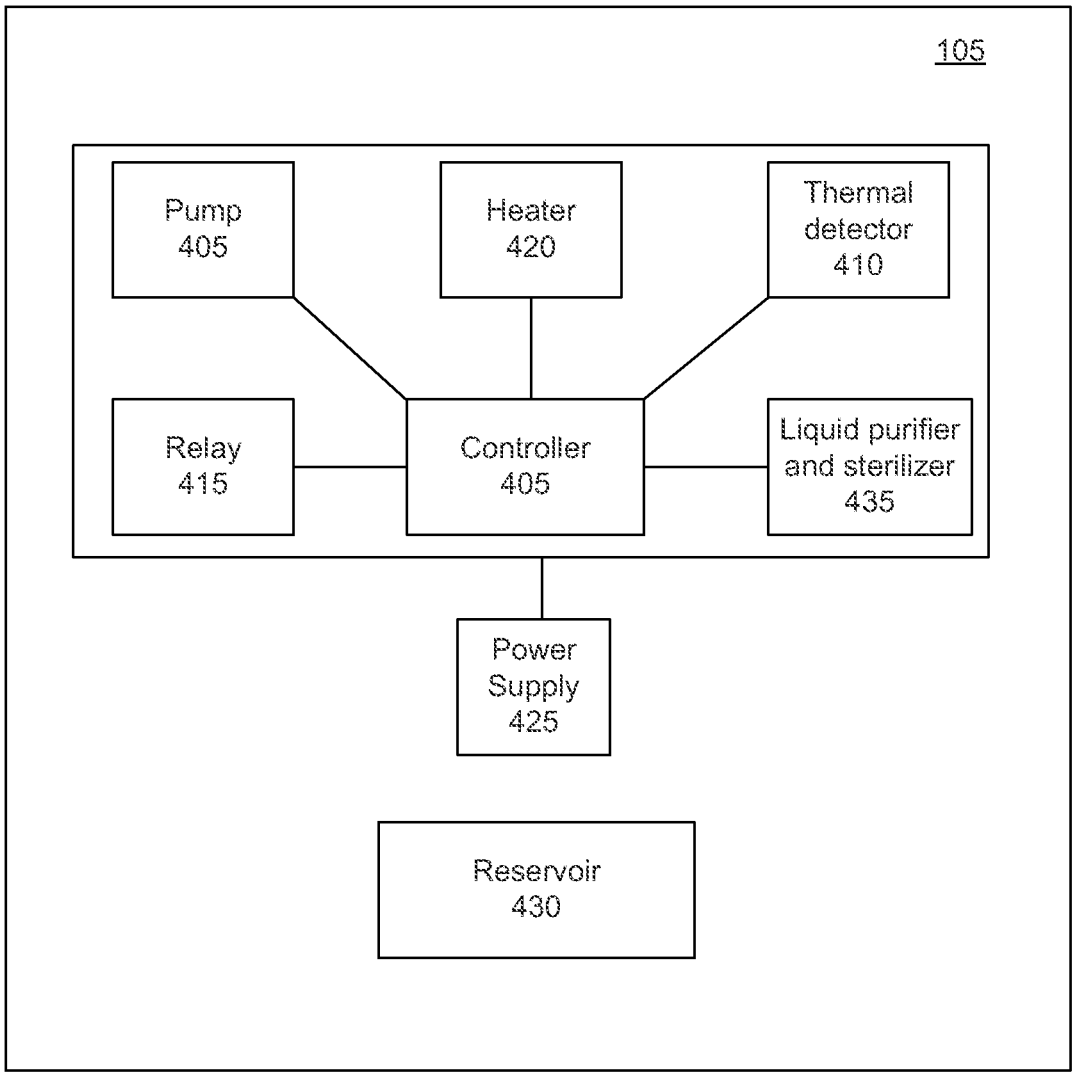
FIG. 4 is a more detailed block diagram that illustrates an embodiment of liquid heater, such as that shown in FIG. 1.

FIG. 4 is a more detailed block diagram that illustrates an embodiment of liquid heater 105, such as that shown in FIG. 1. The liquid heater 105 can maintain liquid temperature in a liquid container 110, 210. A user interface can be used to facilitate turning on-and-off the liquid heater 105 and set a temperature that the user wants the water temperature to be maintained at. A display can show the current temperature of the bath water based off a sensor not near the outlet of the warm water.

Based on the set temperature, the controller 405 detects the liquid temperature via a thermal detector or sensor 410, which is typically located at the inlet structure. The thermal detector or sensor 410 measures the liquid temperature from the liquid container 110, 210 and sends the detected temperature to the controller 405. Responsive to the liquid temperature being lower than the set temperature, the controller 405 turns on a pump 405 and a heating device 420 via relay 415, which can include a solid-state relay. The pump 405 pumps the liquid into the heating device 420 that is used to heat the liquid. The liquid heater 105 can use the pump 405 to circulate the liquid in the liquid container 110, 210 is to keep the water temperature evenly distributed. A liquid reservoir 430 can be configured to be located in the house, attached to the inlet structure and outlet structure, and receives liquid from the liquid container 110, 210. The liquid is pumped by the pump 405 from the liquid container 110, 210, through the inlet structure, into the liquid reservoir 430, and out of the outlet structure.

The heating device 420 can include a thermosiphon, solar reflectors, graphite electrodes, and conventional heating element. The thermosiphon is a technique to heat water using solar energy. A tank separates the hot and cold water by natural convection, and then a siphon is attached to the top and bottom of the tank with a solar collector in-between. The solar collector is meant to capture enough solar energy to keep the water system warm.

Solar reflectors can be used to concentrate the solar energy onto a reservoir 430 in which liquid therein will be circulated into the liquid container 110, 210 to maintain the desired temperature. Graphite electrodes are used in arc furnace steel manufacturing, so the thermal output would be very high. This would mean that the relative surface area required to heat the water would be much less than a conventional heating element. The conventional heating element such as an electric water heater can be used.

The pump 405 can include an axial pump, bladeless fan, and underwater tower fan. The power supply 425 can be from solar energy, wind energy, batteries, and conventional home outlets. The controller can also control a liquid purifier and sterilizer 435 that purifies and sterilizes the liquid. The liquid purifier and sterilizer 435 can include methods that involve charcoal, distillation, deionization, carbon absorption, ultrafiltration, reverse osmosis, and ultraviolet radiation.

Figure 5:
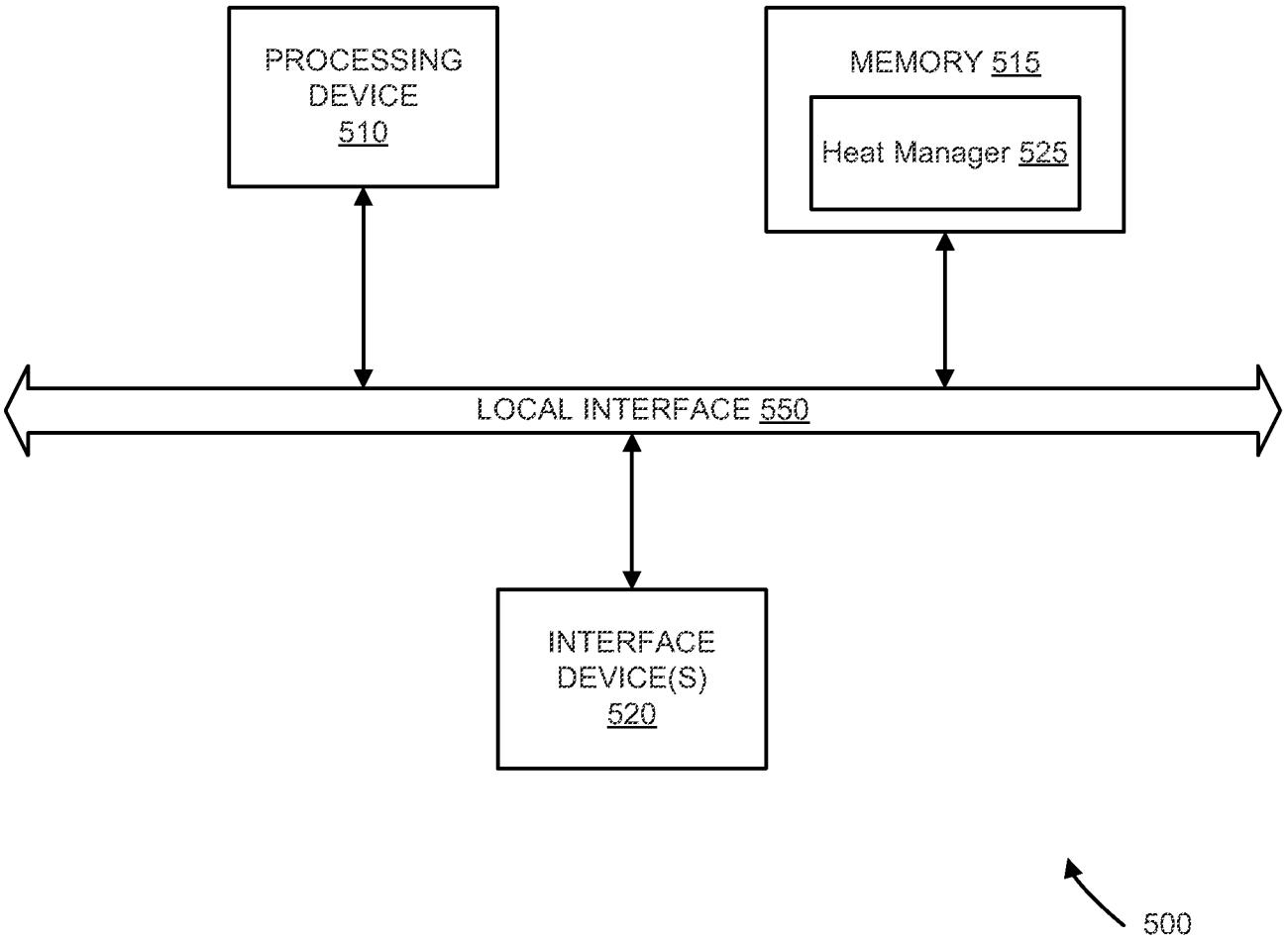
FIG. 5 is a block diagram illustrating an exemplary architecture for a generic computer 500 that is similar to the architecture of the controller 165, such as that shown in FIG. 1.

FIG. 5 is a block diagram illustrating an exemplary architecture for a generic computer 500 that is similar to the architecture of the controller 165, such as that shown in FIG. 1. As indicated in FIG. 5, the computing generic computer 500 comprises a processing device 510, memory 515, and one or more user interface devices 520, each of which is connected to a local interface 550. The processing device 510 can include any custom made or commercially available processor, a central processing unit (CPU) or an auxiliary processor among several processors associated with the generic computer 500, a semiconductor based microprocessor (in the form of a microchip), or a macroprocessor. The memory 515 can include any one or a combination of volatile memory elements (e.g., random access memory (RAM, such as DRAM, SRAM, etc.)) and nonvolatile memory elements (e.g., ROM, hard drive, tape, CDROM, etc.).

The one or more user interface devices 520 comprise those components with which the user can interact with the generic computer 500. The memory 515 normally comprises various programs (in software and/or firmware) including a heat manager 525 that performs the operation, functionality, and architecture of the liquid heater 105, as described above.

The systems and methods disclosed herein can be implemented in software, hardware, or a combination thereof. In some embodiments, the system and/or method is implemented in software that is stored in a memory and that is executed by a suitable microprocessor (μP) situated in a computing device. However, the systems and methods can be embodied in any computer-readable medium for use by or in connection with an instruction execution system, apparatus, or device. Such instruction execution systems include any computer-based system, processor-containing system, or other system that can fetch and execute the instructions from the instruction execution system. In the context of this disclosure, a "computer-readable medium" can be any means that can contain, store, communicate, propagate, or transport the program for use by, or in connection with, the instruction execution system. The computer readable medium can be, for example, but not limited to, a system or propagation medium that is based on electronic, magnetic, optical, electromagnetic, infrared, or semiconductor technology.

Specific examples of a computer-readable medium using electronic technology would include (but are not limited to) the following: an electrical connection (electronic) having one or more wires; a random access memory (RAM); a read-only memory (ROM); an erasable programmable read-only memory (EPROM or Flash memory). A specific example using magnetic technology includes (but is not limited to) a portable computer diskette. Specific examples using optical technology include (but are not limited to) optical fiber and compact disc read-only memory (CD-ROM).

Note that the computer-readable medium could even be paper or another suitable medium on which the program is printed. Using such a medium, the program can be electronically captured (using, for instance, optical scanning of the paper or other medium), compiled, interpreted or otherwise processed in a suitable manner, and then stored in a computer memory. In addition, the scope of the certain embodiments of the present disclosure includes embodying the functionality of the preferred embodiments of the present disclosure in logic embodied in hardware or software-configured mediums.

It should be noted that any process descriptions or blocks in flowcharts should be understood as representing modules, segments, or portions of code which include one or more executable instructions for implementing specific logical functions or steps in the process. As would be understood by those of ordinary skill in the art of the software development, alternate embodiments are also included within the scope of the disclosure. In these alternate embodiments, functions may be executed out of order from that shown or discussed, including substantially concurrently or in reverse order, depending on the functionality involved.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

What is claimed is:

1. A liquid heater that maintains a liquid temperature at a consistent and desirable temperature, comprising:

a housing that houses a power supply and a heating device that receives power from the power supply;

a liquid pump that receives power from the power supply and pumps liquid from a liquid container to the heating element, which heats the water;

a temperature controller that turns on or off the heating element to increase and/or decrease the temperature of the liquid from the liquid container, a mounting structure that includes an inlet structure and an outlet structure, both of which are connected to the housing, wherein the inlet structure receives liquid from the liquid container and the outlet structure ejects the liquid from the housing, wherein the inlet structure and the outlet structure are configured to be in a "U" shape such that the inlet structure and the outlet structure can be mounted on the edge of the liquid container, wherein a base of the U-shaped inlet structure and outlet structure rests on the top edge of the liquid container and the two arms of the U-shaped inlet structure and outlet structure are adjacent to a wet side and a dry side of the liquid container, wherein the base of the U-shaped inlet structure and the outlet structure are configured to be telescopic that expands to accommodate various thicknesses of at least one liquid container.

2. The liquid heater as defined in claim 1, wherein the telescopic base of the U-shaped inlet structure and the outlet structure includes an interior member and an exterior member, wherein the interior member is smaller than the exterior member such that the interior member is housed by the exterior member, the telescopic base further includes a liquid seal fastener between the interior member and exterior member that prevents liquid from leaking out of the telescopic base.

3. The liquid heater as defined in claim 1, further comprising a thermal sensor that measures the liquid temperature from the liquid container and sends the detected temperature to the temperature controller.

4. The liquid heater as defined in claim 3, wherein the temperature controller turns on or off the heating device based on the detected temperature from the thermal sensor.

5. The liquid heater as defined in claim 4, further comprising a solid-state relay that turns on or off the heating element based on the electrical signals from the temperature controller.

6. The liquid heater as defined in claim 1, wherein the liquid pump is positioned along the inlet structure, either on the wet side of the inlet structure or in the housing, or both.

7. The liquid heater as defined in claim 6, wherein the liquid pump is a submersible pump that is positioned on the wet side of the inlet structure.

8. The liquid heater as defined in claim 1, further comprises a liquid reservoir that is attached to the inlet structure and outlet structure and receives liquid from the liquid container, wherein the liquid is pumped by the liquid pump from the liquid container, through the inlet structure, into the liquid reservoir, and out of the outlet structure.

9. The liquid heater as defined in claim 1, further comprises a liquid purifier and sterilizer that purifies and sterilizes the liquid.

* * * * *